United States Patent [19]

Cosse et al.

[11] Patent Number: 4,507,655

[45] Date of Patent: Mar. 26, 1985

[54] MEMORY DEVICE FOR LIGHTING CONTROL PURPOSES

[76] Inventors: Guy Cosse, 171 bis, Avenue Victor Hugo, 92140 Clamart; Bernard Serres, 7, rue des Pommaries, 74000 Annecy le Vieux, both of France

[21] Appl. No.: 377,011

[22] Filed: May 11, 1982

[30] Foreign Application Priority Data

May 14, 1981 [FR] France ..... 81 09611

[51] Int. Cl.[3] ..... G08B 19/00; G09G 3/00

[52] U.S. Cl. ..... 340/641; 340/654; 340/715; 340/527; 340/717

[58] Field of Search ..... 340/654, 715, 527, 641, 340/642, 643, 717

[56] References Cited

U.S. PATENT DOCUMENTS 3,412,395 11/1968 Kiene, Jr. ..... 340/654

3,710,367 1/1973 Barnum ..... 340/641

3,728,705 4/1973 Atkins ..... 340/642

4,092,642 5/1978 Green et al. ..... 340/527

*Primary Examiner*—Marshall M. Curtis

*Attorney, Agent, or Firm*—Oblon, Fisher, Spivak, McClelland & Maier

[57] ABSTRACT

A memory device for lighting control purposes, including, for example a battery. The charge of which is controlled by at least one photodetector, which receives light from a lighting means when the latter is in operation. Charging the battery takes place during an operating period of the lighting means. When the latter is not operating, the battery discharges into a light emitting diode. Thus, the information concerning the satisfactory operation of the lighting means is stored for a certain time and after said operation it is possible to check that the latter has taken place. The device has applicability to the control of a public lighting system.

4 Claims, 1 Drawing Figure

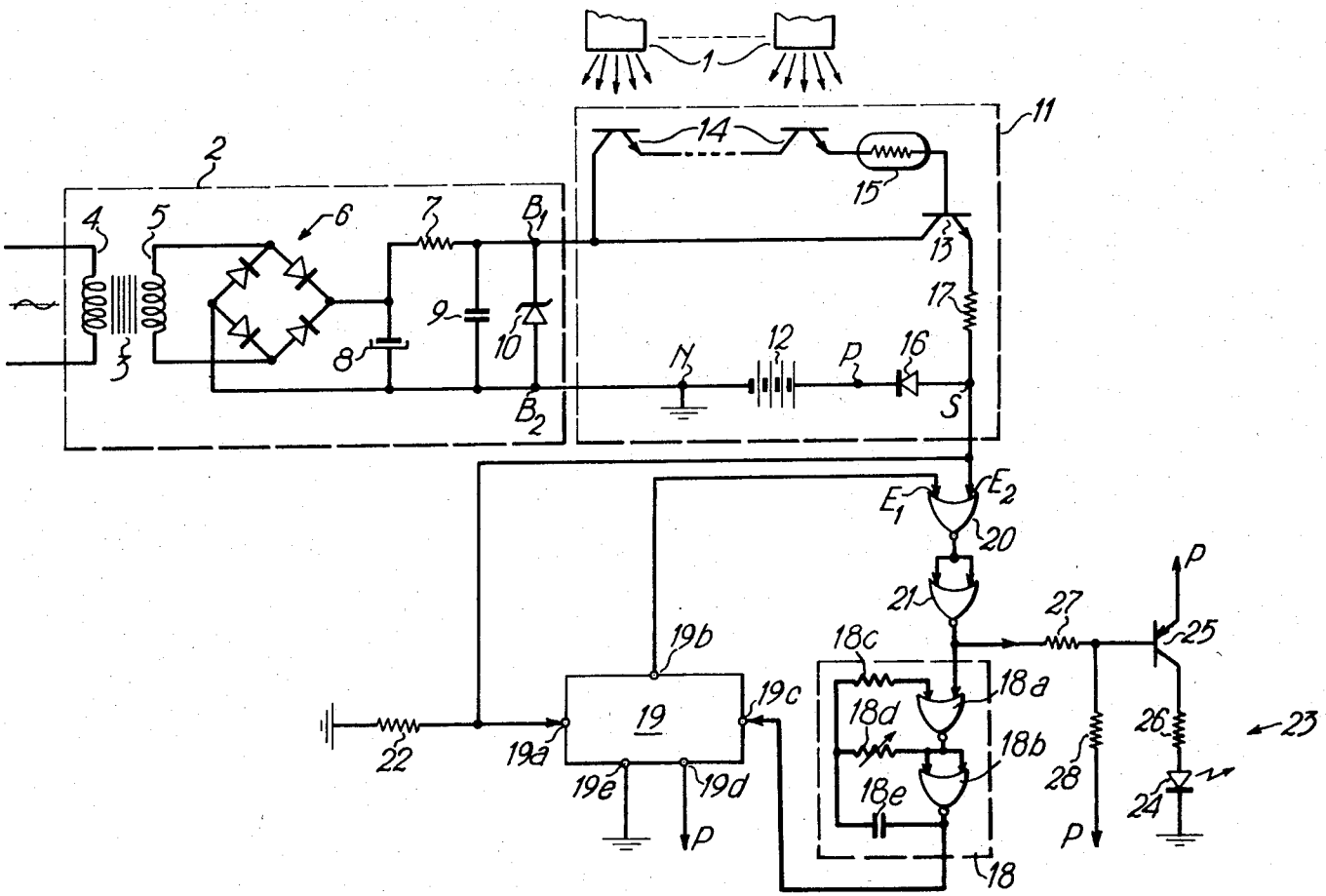
1
2
3
4
5
6
7
8
9
10
11
12
13
14
15
16
17
18
18a
18b
18c
18d
18e
19
19a
19b
19c
19d
19e
20
21
22
23
24
25
26
27
28
P
S
N
E1
E2
B1
B2

MEMORY DEVICE FOR LIGHTING CONTROL PURPOSES

BACKGROUND OF THE INVENTION

The present invention relates to a memory device or unit for lighting control purposes. It is more particularly applicable to the control of the lighting of public telephone kiosks, which are connected to the public lighting network, the latter being switched on at dusk and switched off at dawn. The control of the switching on and off of the lighting system can be carried out by means of a day/night clock or by a photoelectric cell which is sensitive to natural lighting, as a function of the locations. The present invention also applies to the control of the lighting of floor standard lamps, shop windows and signalling, or security lighting sources.

It is known that one of the problems occurring when operating lighting means is to ensure that they function normally, i.e. that their supply voltages are present and that their lighting sources (lamps, tubes, etc) are in a satisfactory state. One possible solution for solving this problem is to send out somebody to see whether the lighting systems are functioning properly, generally at night, or to intercept and collect light presence information and transmit it to a central monitoring station. However, both methods are disadvantageous when there are numerous lighting means to be monitored and when the latter are distributed over a vast territory, e.g. in the case of public telephone kiosks.

BRIEF SUMMARY OF THE INVENTION

The present invention aims at obviating this disadvantage.

The invention therefore specifically relates to a lighting control device, including a means for storing information concerning the operation of at least one lighting means which is intended to operate during at least one time interval. The storage means includes a power accumulator and at least one photodetector. The photodetector receives light from one of the lighting means and controls charging of the accumulator accordingly. The lighting control device further includes a means for indicating the information stored in the accumulator, which indicating means is activated by discharge of the accumulator and serves as a check by which it is possible to ascertain operation of the lighting means.

Thus, the device according to the invention makes it possible to check the satisfactory operation of a lighting system with a time lag. The said lighting system can be automatically or remotely controlled and is intended e.g. to operate at night, without there being any need for anyone to go there during the operating period and without any remote data transmission.

The lighting means to be controlled can serve to operate during one or more time periods. In the latter case, lighting can be of a periodic (case of public lighting system) or non-periodic nature.

Charging takes place when the lighting system is operating (provided that its supply voltage is present and the light source which provides the lighting also functions). After operation of the lighting system, the accumulator discharges and "activates" the signalling or indication means. Moreover, there can be several lighting means, e.g. positioned at different locations to be checked. For this purpose, it is possible to use photodetectors, such as series-connected phototransistors, each of them being associated with a lighting means, in such a way that charging of the accumulator only takes place when all the lighting means are operating.

According to a special feature of the device according to the invention, the storage means also comprise a negative temperature coefficient thermistor for optimizing charging of the accumulator as a function of ambient temperature. The accumulator is very sensitive to the latter. The addition of the thermistor to the device according to the invention leads to a longer service life for the accumulator than would have been the case without the said thermistor.

According to another special feature of the invention, the signalling or indicating means comprise a light source for emitting light after the operation of said lighting means. This light source can be a light emitting diode. Thus, the accumulator can be charged when the lighting system operates and can be discharged when the latter is inoperative into the said diode. The lighting up of the latter constitutes a posteriori evidence of the satisfactory operation of the lighting system to be controlled. Obviously, other indicating means could be used, e.g. a sound source or mechanical means for occupying a predetermined position when the lighting means have operated.

According to a special feature of the device according to the invention, the latter also incorporates a clock and counting means for interrupting the discharge of the accumulation at the end of a predetermined time. In this way, it is possible to limit the discharge time of the accumulator in the case of a breakdown of the lighting means, thereby preventing damage to the accumulator.

The device according to the invention can also be used for controlling the operation of an apparatus, the latter being associated with a light source in such a way that the light source only functions if the said apparatus is functioning or has functioned. It is therefore a question of controlling the light source to control the apparatus.

DESCRIPTION OF THE DRAWING AND PREFERRED EMBODIMENTS

The invention is described in greater detail hereinafter relative to non-limitative embodiments and the attached drawing.

The drawing diagrammatically shows an embodiment of the device according to the invention for controlling lighting means such as lamps 1. This embodiment firstly comprises a stabilized direct current power supply 2, comprising a transformer 3, whose primary 4 is, for example, connected to the 220 V a.c. mains, which can also supply power to lamps 1. The secondary 5 of transformer 3 supplies a rectifying bridge 6, e.g. a GRAETZ bridge, which itself supplies a first electrical resistor 7 making it possible to reduce the voltage at the output of bridge 6, filtering means constituted by an electrolytic capacitor 8 and another capacitor 9, as well as a voltage stabilizing Zener diode 10. Thus, power supply 2 is stabilized and is able to supply a direct current, whilst having a first output terminal $B_1$ at a positive potential and a second output terminal $B_2$ at a negative potential. These two terminals correspond to those of the Zener diode 10.

The device according to the invention which is shown in the attached drawing also comprises means 11 for storing information on the satisfactory operation of lamps 1. These storage means 11 incorporate an accumulator battery 12, a npn transistor 13, phototransistors 14, whose number is the same as that of lamps 1, each of them being associated with one of the lamps 1 and positioned so as to receive the light which can be emitted by the lamp when it operates. The storage means 11 also comprise a negative temperature coefficient thermistor 15, a diode 16 and a second electrical resistor 17.

The npn transistor 13 is connected by its collector to the first terminal $B_1$ and by its emitter to the second resistor 17. The latter, which serves to optimize the charging current of the accumulator battery 12, is connected to a diode 16, which is itself connected to the accumulator battery 12 by the positive pole P of the latter. The negative pole N of battery 12 is connected to the second output terminal $B_2$ or power supply 2 and is also grounded. Diode 16 is connected so as to be reverse-biased with respect to battery 12.

Phototransistors 14 are connected in series and the emitter of one of them is connected to the collector of the following phototransistor and so on. The collector of the first phototransistor of the obtained series is connected to the first output terminal $B_1$ or power supply 2 and the emitter of the last phototransistor of the series is connected to the base of the npn transistor 13 via the negative temperature coefficient thermistor 15.

The device according to the invention also has a clock 18 and counting means or counter 19. Clock 18 is constructed e.g. in per se known manner by means of two NOR gates 18*a* and 18*b*, a fixed resistor 18*c*, a variable resistor 18*d* to enable the frequency of clock 18 to be regulated, and a capacitor 18*e*. Counter 19 is of the type marketed by the MOTOROLA company under the reference MG 14521 (counters with CMOS integrated circuits). A first input 19*a* of counter 19, corresponding to the resetting of the latter, is connected to a point S between the second resistor 17 and diode 16. An output 19*b* of counter 19 is connected to an input $E_1$ of a first NOR gate 20, whose other input $E_2$ is connected to point S. The output of the first gate 20 is connected to two inputs of a second NOR gate 21, whose output is connected to the input of clock 18. The output of clock 18 is connected to a second input 19*c* of counter 19. The latter is connected, respectively by two terminals 19*d* and 19*e*, to the positive pole P of battery 12 and to earth in such a way as to be supplied with electric power. In the same way, battey 12 supplies (in a not shown manner) electric power to the four NOR gates 18*a*, 18*b*, 20 and 21.

A third resistor 22 is, on one side, connected to earth and, on the other, to the other input $E_2$ of the first NOR gate 20 in order to fix the potential of said other input $E_2$.

The device according to the invention also has signalling or indicating means 23 incorporating a light emitting diode 24 connected to the collector of a PNP transistor 25 by means of a fourth resistor for limiting the current in diode 24. The emitter of the PNP transistor 25 is connected to the positive pole P of battery 12. The light emitting diode 24 is also connected to earth and is obviously connected in such a way as to be forward biased with respect to battery 12 when the PNP transistor 25 conducts current. The base of transistor 25 is connected via a fifth resistor 27, provided for the polarization of said transistor, to the output of the said NOR gate 21. A sixth resistor 28, also provided for the polarization of transistor 25, connects the positive pole P of battery 12 to a point located between the fifth resistor 27 and the base of the PNP transistor 25.

The special embodiment of the device according to the invention shown in the drawing makes it possible to control several lamps 1 by means of several phototransistor 14 connected in such a way that the light emitting diode 24 only lights up when all the lamps 1 to be controlled have operated. The arrangement and connection of the phototransistors 14 have been described hereinbefore. Obviously, the embodiment would only have a single phototransistor 14 if only a single lamp 1 had to be controlled.

The device according to the invention operates in the following way. Using as an example lamps 1 intended for public lighting purposes and therefore subject to on - off cycles, when all the lamps 1 are on (at night), the light which they emit is detected by phototransistors 14, which makes the latter conductive and enables the unblocking of the PNP transistor 13, which is thus made conductive and battery 12 can charge as a result of power supply 2. Moreover, point S is then at a high voltage level. This also applies for the first input 19*a* of counter 19, which brings about the resetting of the latter, and for the other input $E_2$ of the first NOR gate 20, which also brings the output of said NOR gate 21 to a high voltage level.

The input of clock 18 and the base of the PNP transistor 25 are consequently raised to a high voltage level. Therefore, clock 18 is blocked and so is transistor 25, which brings about the extinction of the light emitting diode 24 (assumed to be ignited during the previous day) and the stopping of the discharge of battery 12 into said diode 24.

When the lamps 1 are off (during the following day), no light reaches phototransistors 14 and the npn transistor 13 is consequently blocked. There can be no further charging of battery 12. Thus, point S is at ground potential and the other input $E_2$ of the first NOR gate 20 is at logic level 0. Input $E_1$ of first gate 20 is also at logic level 0 because counter 19 has been reset. Thus the output of the second gate 21 and consequently the input of clock 18 are also at logic level 0. Clock 18 is then unblocked and transmits pulses to the second input 19*c* of counter 19, which counts the transmitted pulses. Moreover, the PNP transistor 25, whose base is connected to the output of the second gate 21 is rendered conductive. Light emitting diode 24 is then conducts and emits light (indicating the satisfactory operation of lamps 1 during the preceding night), because battery 12 can then be discharged. Diode 16 prevents the discharge of battery 12 taking place in the direction of npn transistor 13 and also makes it possible to prevent the point S being permanently at a positive potential.

When night falls again, if lamps 1 light up again, the process following their lighting is repeated in the manner described hereinbefore, with the recharging of battery 12 and so on. If at least one of the lamps 1 does not light up again, as a result of a main power supply failure, or an unsatisfactory operation of the lamp, battery 12 continues to discharge for a certain time. At the end of a given number of pulses (corresponding e.g. to 20 hours of discharging), output 19*b* of counter 19 is raised to logic level 1. The same applies with regards to input $E_1$ of the first gate 20 and consequently with regard to the output of the second gate 21 and therefore with regard to the input of clock 18, which is then blocked again. In the same way, the PNP transistor 25, the base of which is then raised to a high voltage level, is also blocked. Diode 24 is extinguished and battery 12 stops discharging and is consequently not entirely emptied, which would have a disadvantageous effect on its life. When all the lamps 1 have again come on, the process following their lighting up and as described hereinbefore is repeated. Counter 19 is reset.

For information purposes, it is possible to use the approximate values given hereinafter for the resistors and capacitors of the device according to the invention and as described hereinbefore.

| Resistor | Value | Max. power dissipatable into the resistor. (in W) |
|---|---|---|
| first 7 | 270Ω | 0.5 |
| second 17 | 68Ω | 0.5 |
| third 22 | 1 MΩ | 0.25 |
| fourth 26 | 680Ω | 0.5 |
| fifth 27 | 8.2 kΩ | 0.25 |
| sixth 28 | 150 kΩ | 0.25 |
| fixed 18c | 220 kΩ | 0.25 |
| variable 18d | 470 kΩ | 0.25 |
| Electrolytic capacitor 8: | | 100 μF. |
| Other capacitor 9: | | 10 nF |
| Capacitor 18e of clock 18: | | 0.1 μF |
| Max. voltage which can be withstood by the three capacitors 8, 9 and 18e: | | 25 V. |

Phototransistors 14, npn transistor 13 and PNP transistor 25 are of the type having respectively for their reference BP103B, 2N2222 and BC179.

Transformer 3 is, for example, designed to give 12 V a.c. to the secondary 5, when the primary 4 is connected to the main power supply (220 V a.c.). The power of transformer 3 is e.g. 3 VA. The Zener diode 10 is, for example, intended to stabilize the voltage to 8 V between its terminals $B_1$ and $B_2$ and the accumulator battery 12 is e.g. a miniature cadmium-nickel accumulator battery, the capacitance of which is approximately 500 milliamperes-hour and which, when charged, has a voltage of 5 V between its terminals.

The negative temperature coefficient thermistor 15, having for example a resistance of 16 kΩ at 20° C., makes it possible to optimize the charge of battery 12 as a function of ambient temperature to which the accumulators are very sensitive. Its addition to the device according to the invention makes it possible to expect that the battery 12 given in exemplified manner hereinafter will have a service life of approximately 2000 cycles (charges- discharges) i.e. approximately 6 years on the basis of 1 cycle per 24 hours.

In the device according to the invention shown in the drawing and constructed with components, whose values or types have been indicated hereinbefore, the charging - discharging energy balance corresponds, for a 60% accumulator discharge, to 6 charging hours (on-period of lamps 1), which is a minimum for a public lighting system in summer, and 20 discharging hours (off-period of lamps 1), which leaves plenty of time to carry out the control. The sum of these two periods (6 and 24 hours) exceeds 20 hours, so that there is no uncertainty if light emitting diode 24 is activated during the control it means that lamps 1 have operated during the on-period.

In the case of a failure of lamps 1 during this on-period, battery 12 can be incompletely charged and, as a function of the observation time, diode 24 may or may not be ignited. When the illumination fault is complete, the diode will certainly be extinguished during the following observation.

The device as described hereinbefore can be placed in a case, whose dimensions can be approximately 10×7×5 cm. The photodetector or photodetectors 14, as well as the light emitting diode 24, can be integrated into the case or can be separate therefrom. It is obviously possible to use several photodetectors 14 for each lamp 1.

The device according to the invention, which permits, with a time lag, a control of lighting means can, as a function of its cost and the importance attached to the supervision of these lighting means, be used permanently or occasionally, depending on the reliability level of the supervised lighting means.

What is claimed is:

1. A lighting control device comprising:

storage means for storing information concerning operation of at least one lighting means during operation of said lighting means over at least one time interval, said storage means comprising, at least one photodetector which receives light from said lighting means during operation of said lighting means, and electric power accumulator means connected to said at least one photodetector for accumulating charge during operation of said lighting means, wherein the accumulation of charge by said accumulator means is controlled by said at least one photodetector; and signalling means coupled to said storage means for signalling said information stored in said storage means, said signalling means being activated by a discharge of said accumulator means, said signalling means enabling verification of operation of said lighting means only after operation of said lighting means.

2. A device according to claim 1, wherein the storage means also comprise a negative temperature coefficient thermistor for optimizing the charging of the accumulator means as a function of the ambient temperature.

3. A device according to claims 1 or 2, wherein the signalling means comprise a light source for emitting light after the operation of the lighting means.

4. A device according to claim 1, wherein it also comprises a clock and counting means for interrupting the discharge of the accumulator means at the end of a predetermined time.

* * * * *